US006247588B1

(12) United States Patent
McCreary

(10) Patent No.: US 6,247,588 B1
(45) Date of Patent: Jun. 19, 2001

(54) SECURITY ASSEMBLY FOR A GOLF BAG

(76) Inventor: Linda K. McCreary, 2712 Oak Tree La., Oakland Park, FL (US) 33309

( * ) Notice: Subject to any disclaimer, the term of this patent is extended or adjusted under 35 U.S.C. 154(b) by 0 days.

(21) Appl. No.: 09/479,104

(22) Filed: Jan. 7, 2000

(51) Int. Cl.[7] ..... A63B 55/00; A63B 57/00

(52) U.S. Cl. ..... 206/315.4; 206/315.3; 150/159

(58) Field of Search ..... 206/315.3, 315.4; 150/159; 70/69, DIG. 34

(56) References Cited

U.S. PATENT DOCUMENTS

| | | | | |
|---|---|---|---|---|
| 1,119,508 | * | 12/1914 | Headley | 206/315.4 |
| 1,149,028 | * | 8/1915 | Chapman | 206/315.4 X |
| 1,928,922 | * | 10/1933 | Adams | 206/315.4 |
| 5,109,578 | | 5/1992 | Cox | 24/298 |
| 5,209,280 | | 5/1993 | Gevas | 150/159 |
| 5,226,464 | | 7/1993 | Solov | 150/159 |
| 5,280,798 | | 1/1994 | Helm | 150/159 X |
| 5,458,240 | * | 10/1995 | Rich et al. | 206/315.3 |
| 5,507,332 | * | 4/1996 | McKinnon | 206/315.4 X |
| 5,560,485 | | 10/1996 | O'Hara, Jr. | 206/315.4 |
| 5,582,043 | * | 12/1996 | McCue et al. | 206/315.4 X |
| 5,904,247 | | 5/1999 | Voelkner, Jr. | 206/315.4 |

* cited by examiner

*Primary Examiner*—Sue A. Weaver
(74) *Attorney, Agent, or Firm*—Robert C. Kain, Jr; Fleit Kain

(57) ABSTRACT

A security assembly for a golf bag which is structured to restrict unauthorized access to the interior of the golf bag and the clubs therein as well as prevent or restrict unauthorized removal of the golf bag from an intended, supported position such as on a golf cart or like location. A plurality of holders, preferably having a substantially closed or ring like configuration, are fixedly or removably mounted,on the golf bag in spaced but generally adjacent relation to the open end thereof, wherein the plurality of holders pass at least partially through correspondingly disposed openings formed in a hood, which in turn is mounted in overlying, covering relation to the open end of the golf bag. An elongated retainer member passes through or is otherwise connected to the plurality of holders so as to be disposed in overlying, retaining relation to the hood thereby preventing its unauthorized removal. An access assembly is disposed and structured to separate two hood segments defining the hood, wherein the access assembly may be selectively disposed to at least partially or fully open the hood by separating the hood segments. An elongated connecting member is removably attachable to the golf bag at one or more locations and lockingly but removably secured to a support or mounting structure, such as a golf cart on which the golf bag is supportingly positioned.

25 Claims, 6 Drawing Sheets

SECURITY ASSEMBLY FOR A GOLF BAG

BACKGROUND OF THE INVENTION

1. Field of the Invention

This invention relates to a security assembly for a golf bag and includes a hood removably mounted in overlying, covering relation to an open end of the golf bag, as well as the clubs maintained therein, thereby preventing unauthorized access to and removal of the golf clubs from the golf bag. A removable but lockingly attached connecting member may also be connected to the golf bag and extend outwardly therefrom into secured engagement with a golf cart or other supporting object on which the golf bag is positioned, so as to prevent an unauthorized removal of the golf bag, whether or not the hood is in its protective, closed position relative to the golf bag interior. Authorized access to the golf clubs is easily provided while the security assembly is operatively positioned on the golf bag, so as to facilitate play while maintaining security.

2. Description of the Related Art

In recent years golf has been recognized as one of the fastest growing sports, based on an ever increasing number of players participating in the game of golf throughout the world. With this increasing popularity, the sale and use of golf equipment, including clubs, golf bags, golf carts, balls and various other items, associated with the game of golf, has also increased at a dramatic rate. Over the years and especially within the last twenty years, there is a significant emphasis in the golf industry for the production and design of new and innovative equipment, which would help improve a player's performance. A typical example of such improvements is the change of materials from which such equipment, particularly golf clubs, are made. The improvement and structural design of golf clubs, as well as other equipment associated with the game of golf has led to better overall performance, even by the average or less experienced player. However, the cost of such improved equipment is also significantly increased to the point where a single club, such as a Titanium driver, could cost several hundred dollars. A full set of golf clubs, plus a golf bag and other equipment needed for play, may cost as much as several thousand dollars.

Unfortunately, this significant increase in value of golf equipment has frequently resulted in an increase in the rate of theft of such equipment. In order to overcome the resulting problems associated with the protection of golf equipment during play or practice sessions, as well as during the temporary storage of such equipment, there have been numerous attempts to provide a variety of security devices, which would prevent or at least significantly reduce the possibility of a player's equipment being stolen. Most of the known or conventional structures attempting to protect a golfer's equipment against theft are directed to enclosures, containers, lockers or like structures which tend to enclose the conventional bag and/or hood and serve to protect the golf bag from external damage. Yet other known or conventional devices are directed to one or more locks, cables or like components, which are selectively attachable to the typical golf bag or directly to the clubs .

One problem common to the use of a majority of these known security structures is the inability to allow a player to have free and easy access to the clubs during practice or playing sessions. By way of example, and as set forth above, certain types of known protective containers, boxes or like enclosures are primarily intended to provide security only when the golf bag and/or clubs are being shipped or otherwise transported. During actual play, however, when a player intends to repeatedly use the various clubs within the golf bag, such security enclosures are useless. Similarly, known retaining devices, locks, and like components designed to be secured to the conventional golf bag, also have a tendency to prevent or at least restrict easy access to the various golf clubs, while a player is practicing or involved in a round of golf. Therefore, due to the fact that conventional or known security devices include the above noted disadvantages, a player's equipment almost always remains unprotected especially during play or when a player finishes play and temporarily leaves his or her clubs in a normally familiar storage location for only a brief period of time.

Accordingly, while the above type of conventional security devices or assemblies are assumed to be at least generally functional for their intended purposes, there still exists numerous problems associated with the use of such conventional security devices. Also, the failure of a player to use any type of security device is particularly dangerous in light of the fact that there appears to be an increase in the rate of theft of golf equipment, when golf bags are left alone in a somewhat public or even semi-private location, including public golf courses and private golf clubs throughout the world.

Accordingly, there is a need in the art for an improved security assembly specifically designed and structured to prevent unauthorized access to and/or removal of golf clubs from the interior of a conventional golf bag. If any such improved security assembly were developed, it should also be capable of preventing removal of the entire golf bag from an intended location, such as when it is mounted on a golf cart or otherwise temporarily positioned in a common storage area, immediately before or after play. Also, any such improved security assembly should be specifically designed and structured to accommodate the various sizes and designs of the large number of golf bags now commercially available. Any such security assembly should also be capable of providing the intended security, not only to the golf clubs or other contents of the golf bag, but also to the entire golf bag and any accompanying hood structure. The security provided by any such improved security assembly should be maintained even during use of the golf clubs, in a manner which allows free and easy access to the golf clubs, while the security assembly is operatively connected to or mounted on the golf bag.

SUMMARY OF THE INVENTION

The present invention is directed to a security assembly specifically structured to be used on any of a variety of differently configured and dimensioned, commercially available golf bags, wherein unauthorized access to the interior of the golf bag and/or the golf clubs contained therein, is prevented or significantly restricted. In addition, the security assembly of the present invention is designed to prevent or reduce the possibility of the unauthorized removal of the entire golf bag, along with its contents from an intended location, such as a golf cart or a temporary storage area.

More specifically, the security assembly of the present invention comprises a hood formed preferably of a water resistant, heavy duty, penetration or cut resistant material, being dimensioned and configured so as to be readily adaptable for its operative positioning in overlying, enclosing and covering relation to the open end of any one of a large number of conventional golf bags. In addition, the security assembly of the present invention includes a holder assembly comprising a plurality of holders disposed in spaced apart relation to one another. The plurality of holders are either fixedly or removably mounted on the golf bag in spaced relation to one another and in spaced but adjacent relation to the open end of the golf bag. In addition, the plurality of holders collectively surround the golf bag in the aforementioned spaced relation below the open end thereof.

In one embodiment of the present invention, the plurality of holders can be fixedly or permanently secured to the golf bag, in the above noted location, by being attached by the original manufacturer of the golf bag at the time of its production. Alternatively, another embodiment of the present invention includes the holder assembly comprising an elongated mounting member removably but securely and lockingly attached to the golf bag. The plurality of holders are secured in the aforementioned spaced relation to one another along the length of the elongated mounting member and as such, are collectively disposed in at least partially surrounding relation to the golf bag and in spaced but adjacent relation to the open end thereof. In this latter embodiment, the plurality of holders can be selectively attached to or removed from the golf bag, in the intended position when the player decides to mount the security assembly of the present invention on his or her existing golf bag. The aforementioned hood is secured to the holder assembly through the provision of a plurality of openings or apertures formed along the lower, open end of the hood, substantially adjacent to a periphery thereof and in spaced relation to one another. The position of the openings substantially correspond to the location of each of the holders and are correspondingly dimensioned and configured to allow extension of each of the holders through a correspondingly positioned one of the apertures, so as to extend outwardly therefrom.

Each of the holders preferably includes an at least partially closed configuration, which may be in the form of a ring like holder structure. A retaining assembly including an elongated retaining member is connected to the plurality of holders, such as by being passed therethrough, so as to be disposed in overlying, retaining engagement to the lower portion of the hood. This placement of the elongated retaining member thereby further serves to secure the lower open end of the hood in overlapping relation to the exterior surface of the golf bag. Further, the retaining member is cooperatively structured with the plurality of holders so as to retain the lower end of the hood in a close fitting proximity to the outer surface of the golf bag adjacent to the open end of the golf bag. Unauthorized access to the interior of the golf bag is thereby significantly reduced by preventing passage of a hand, tool or other object beneath the hood and between the interior surface of the hood and the exterior surface of the golf bag.

The security assembly of the present invention further includes a connecting member secured to the golf bag at any one of a plurality of locations and having a sufficiently elongated configuration to removably but lockingly engage an adjacently disposed object, such as the support frame of a golf cart, on which the bag is placed for temporary support or storage. The elongated connecting member can be passed through the handle, normally found on most conventional golf bags or can be removably connected to the holder assembly at any point along its length, dependent on the orientation of the golf bag when it is mounted on a golf cart or disposed at a variety of other locations during the temporary storage of the golf bag.

Another important feature of the security assembly of the present invention is the ability to provide clear and easy access to the golf clubs, while the security assembly is disposed in its intended operative position on the golf bag. More specifically, an access assembly is connected to the hood and includes two closure structures each of which may be in the form of an elongated zipper or other applicable closure. Each of the zippers includes an operative member in the form of a "pull" selectively disposable along the different lengths of an opening which separates the hood into two segments. The opening provides access to the golf bag interior when one or both zipper structures are at least partially disposed in an open position. More specifically, the opening formed in the hood is defined by the peripheral edges of the two correspondingly configured and dimensioned hood segments. The closure structures removably interconnect the opposite peripheral edges of the opening and may be selectively disposed between an open or closed position. Further, each of the zippers defining the closure structures is manipulated separately, thereby allowing access to only a selected few of the clubs within the bag, such as the "irons", while the "woods" remain at least partially or substantially covered. The pulls of the two closure structures may be lockingly connected to one another so as to prevent unauthorized access to the interior golf bag by selectively and independently moving the pulls from their open position to their closed position.

These and other objects, features and advantages of the present invention will become more clear when the drawings as well as the detailed description are taken into consideration.

BRIEF DESCRIPTION OF THE DRAWINGS

For a fuller understanding of the nature of the present invention, reference should be made to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
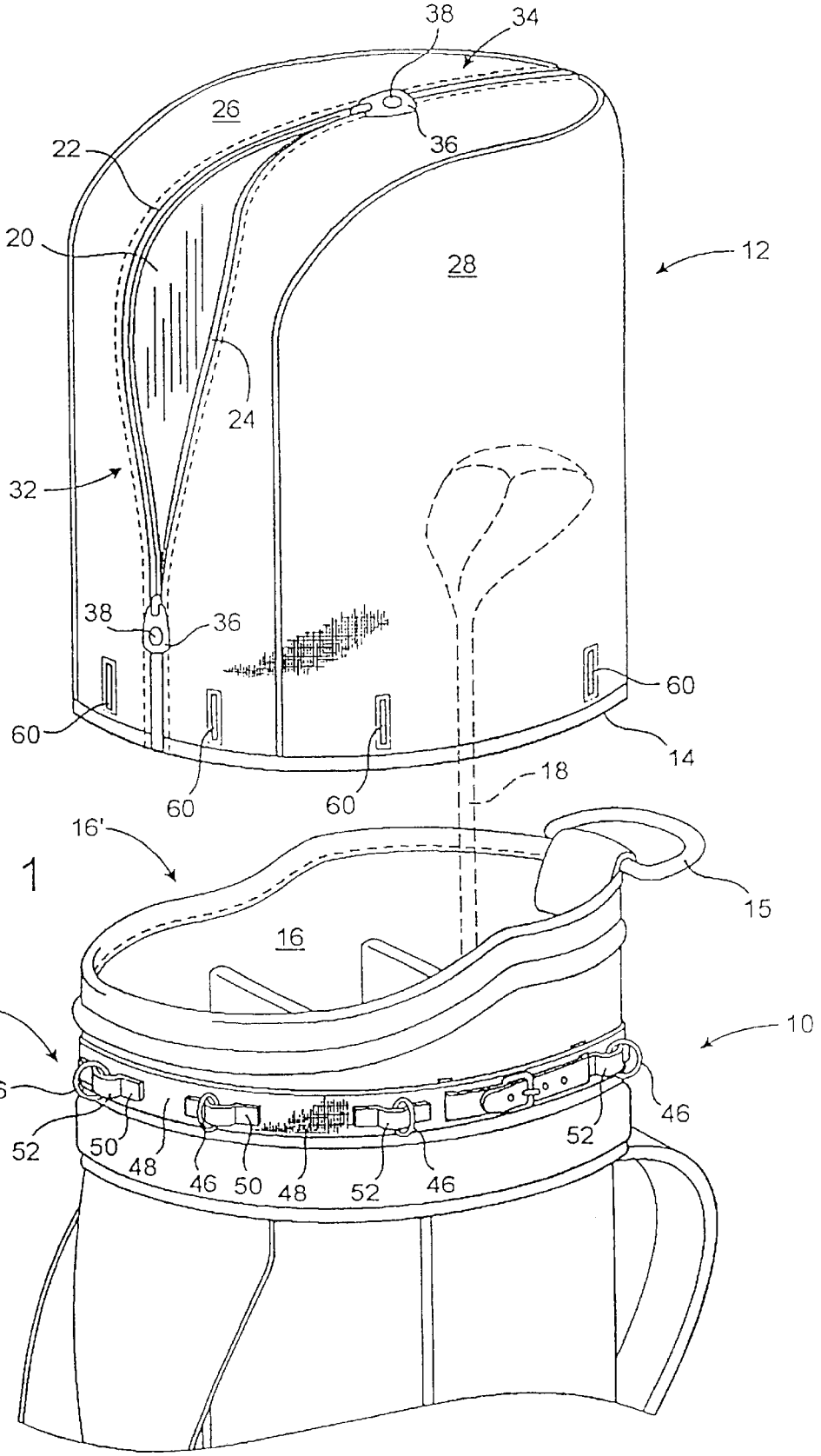
FIG. 1 is an exploded, perspective view in partial phantom of the security assembly of the present invention.

As shown in the accompanying drawings, the present invention is directed to a security assembly for a golf bag, wherein the golf bag, generally indicated as 10, is intended to be representative of a variety of commercially available golf bags having various dimensions and configurations. As such, the golf bag 10 includes certain standard features including a connecting ring 15, to which a shoulder sling is attached, a handle 17, a plurality of partitions 19, located within the bag 10 and a supporting belt 21 for the partitions 19.

The security assembly includes a hood, generally indicated as 12 and including a lower open end 14. The hood 12 is dimensioned and configured to fit in overlying, surrounding relation to the open end 16 of the golf bag 10 in a manner which clearly covers and encloses the plurality of golf clubs, represented in phantom as 18, normally contained within the golf bag 10. In addition, the hood 12 includes an opening 20, which extends along the correspondingly positioned peripheral edges 22 and 24 of each of two correspondingly dimensioned and configured hood segments 26 and 28. Naturally, the dimension and configuration of each of the hood segments 26 and 28 may vary from one another. However, the overall configuration of the hood segments 26 and 28 should collectively define the dimension and configuration of the hood 12 in a manner which assures sufficient versatility to enclose the interior of golf bags 10 of different sizes and shapes, in the manner shown in FIGS. 2 and 3.

Figure 2:
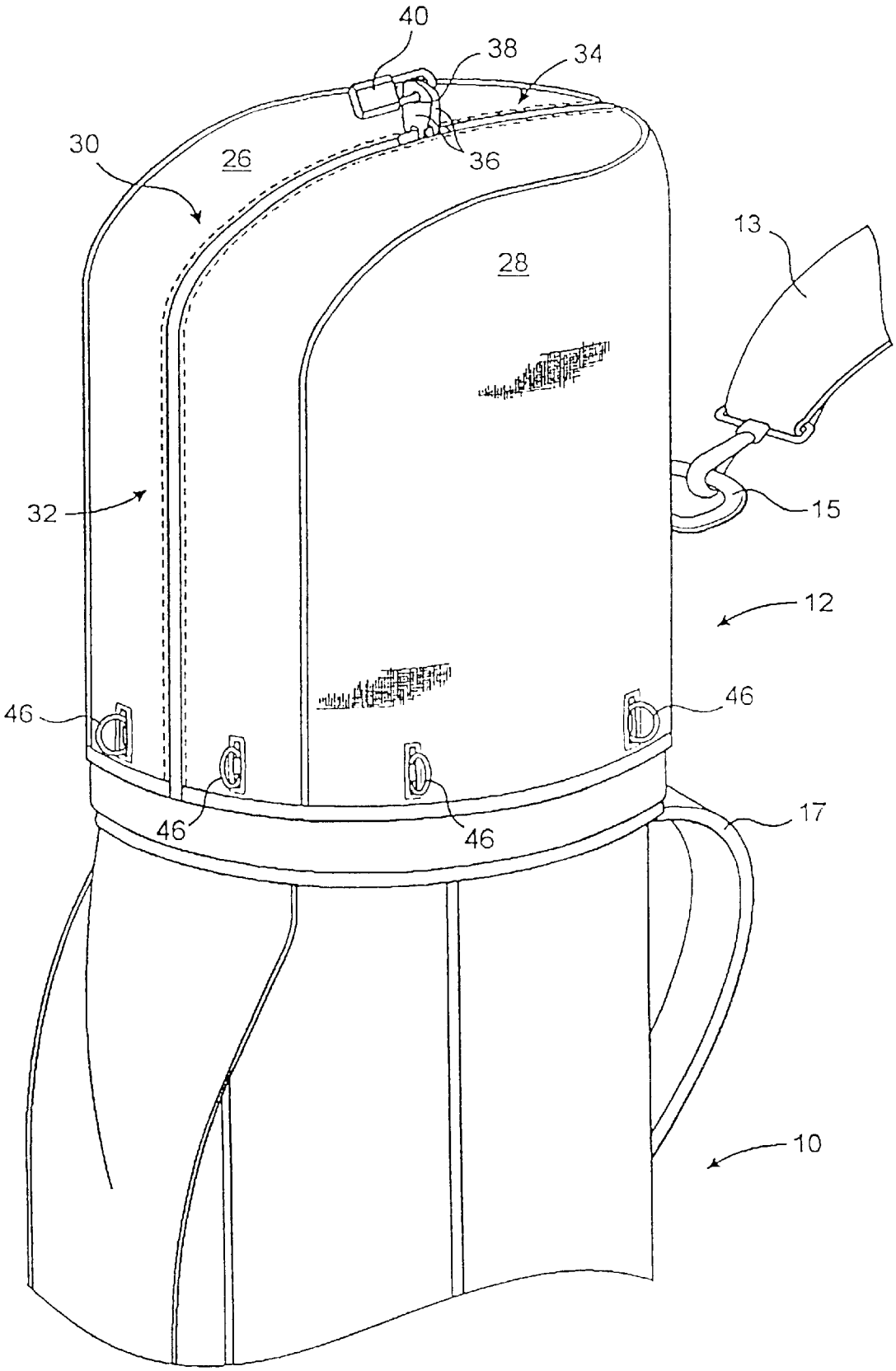
FIG. 2 is a perspective view of the security assembly of the present invention in at least partially assembled form.
Figure 3:
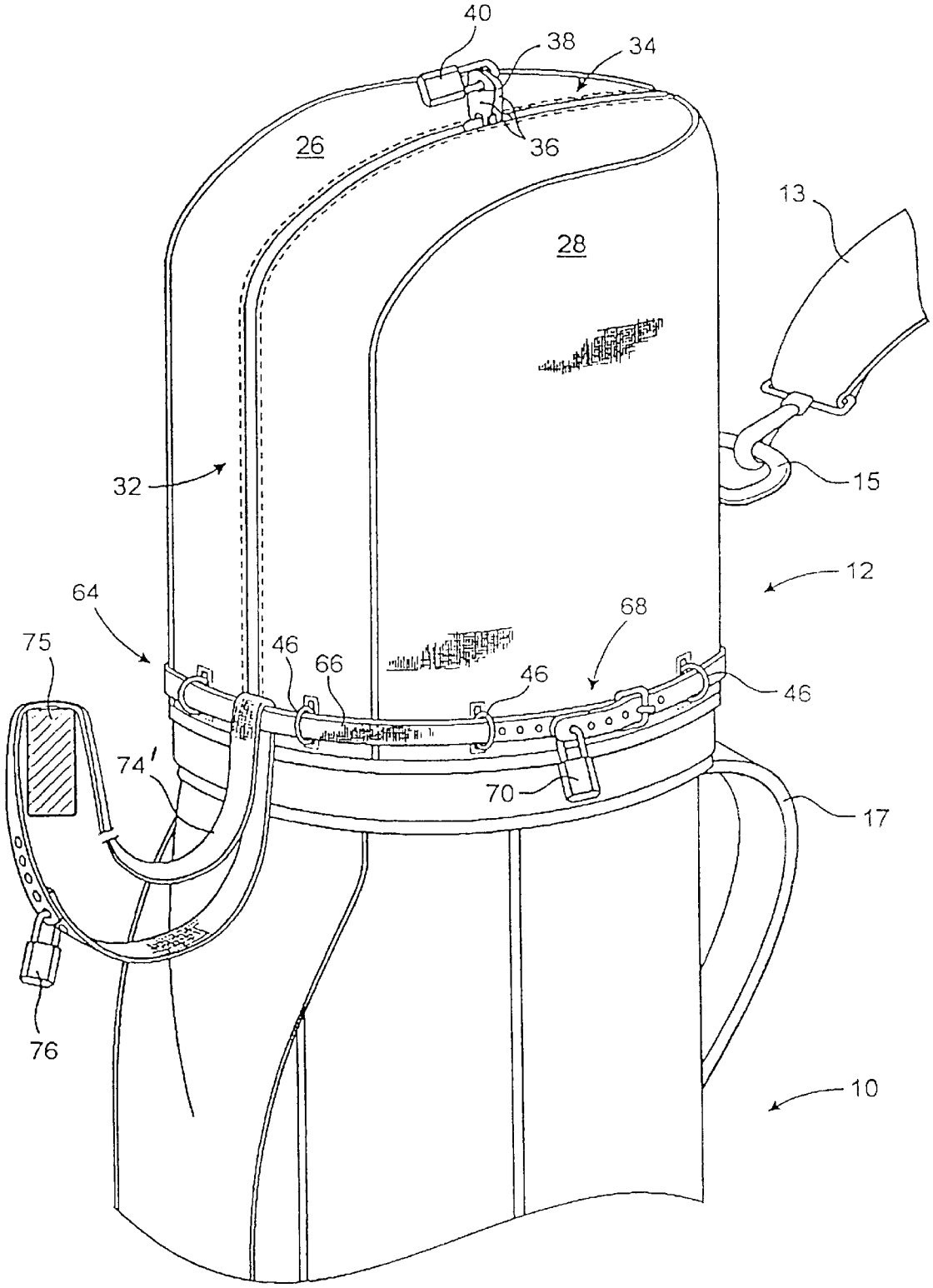
FIG. 3 is a perspective view of the security assembly of the present invention in a completely assembled form.

As best shown in FIGS. 1 through 3, the security assembly of the present invention also includes an access assembly generally indicated as 30 and including two closure structures 32 and 34, which in the embodiment shown comprise two elongated zippers. Each of the zippers 32 and 34 are disposed in interconnecting relation to the peripheral edges 22 and 24 of the hood segments 26 and 28 and extend along different, substantially oppositely disposed lengths of the opening 20. Each of the closure structures or zippers 32 and 34 include an operative member in the form of a pull element 36 which is apertured or otherwise structured as at 38, so as to be removably connected in locking engagement with one another by means of a conventional or customized lock 40. When the hood 12 is mounted in its intended secured position, as best shown in FIGS. 2 and 3, access to the interior of the golf bag 10 and the various clubs 18 contained therein, is easily accomplished by the selective positioning of at least one of the pulls 36, associated with either of the zippers 32 or 34. More specifically, when the hood 12 is closed, both pulls 36 are disposed adjacent to one another on a top portion of the hood 12. The hood 12 is at least partially opened by moving one of the pulls 36 along its length from the top of the hood downwardly towards the periphery of the open end 14, such that the segments 26 and 28 are at least partially separated as shown in FIG. 1. In this at least partially open position, access to the "irons", located at a lower most end 16' of the open end 16 is easily provided. Concurrently, the "woods" or the longer clubs 18, remain at least partially covered by maintaining at least a portion of the hood 12 in its closed position. Naturally, either of the closure structures or zippers 32 and 34 can be completely opened to provide clear and easy access to all of the golf clubs maintained within the interior of the golf bag 10. This completely open position is accomplished by disposing pulls 36 from their closed or top most position, as shown in FIGS. 1 though 3, to their bottom most position at least partially demonstrated in FIG. 1, adjacent to the periphery of the lower, open end 14 of the hood 12.

Another feature of the present invention comprises a holder assembly generally indicated as 44 and including a plurality of holders 46 preferably having a substantially closed configuration, such as by the holders 46 each being defined by an annularly configured ring or like structure. The holders or rings 46 are disposed in spaced relation to one another and are collectively arranged in substantially surrounding relation to the golf bag 10, adjacent to but in somewhat spaced relation beneath the open upper end 16 of the golf bag 10, as best shown in FIG. 1. Further, in the embodiment shown, the holder assembly 44 includes a mounting member 48 having each of the holders 46 secured thereto. Therefore, the holders 46, along with the mounting member 48, may be removably attached in surrounding relation to the golf bag 10 in the preferred, intended position shown in FIG. 1. Each of the holders 46 are removably but securely fastened to the elongated mounting member 48 by means of connecting brackets 50. Each of the brackets 50 include an outwardly extending portion 52 having a somewhat rounded or flat exterior surface, so as to reduce the possibility of the brackets 50 becoming inadvertently engaged with a another object, such as an adjacently positioned golf bag or other article.

Figure 5:
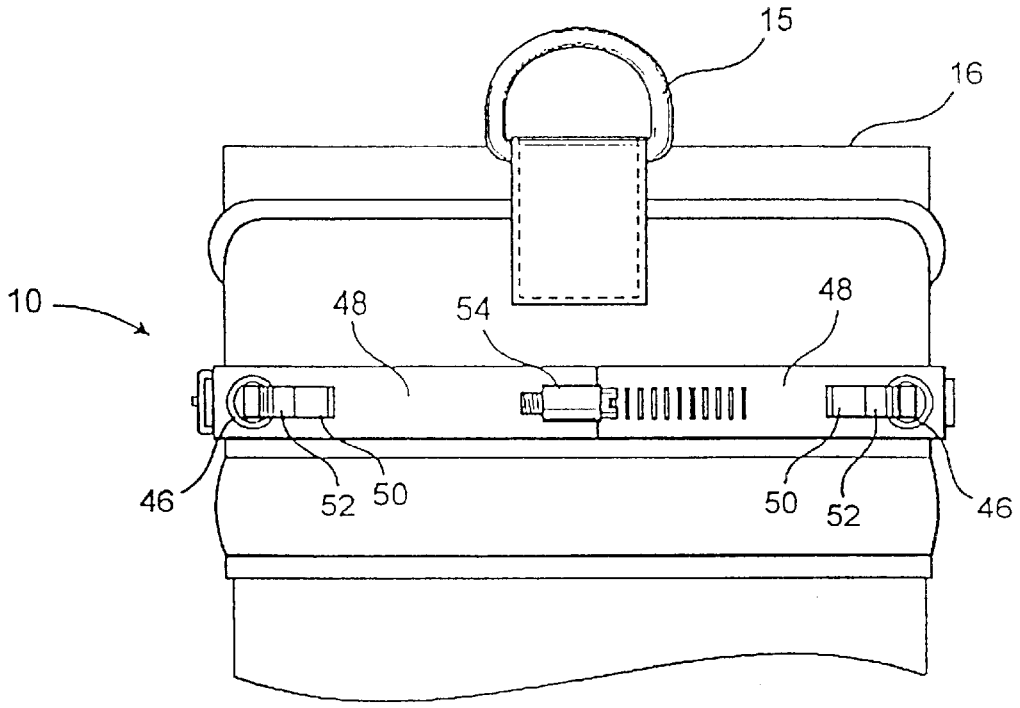
FIG. 5 is a front view in partial cutaway showing details of the holder assembly of the security assembly of the present invention.
Figure 6:
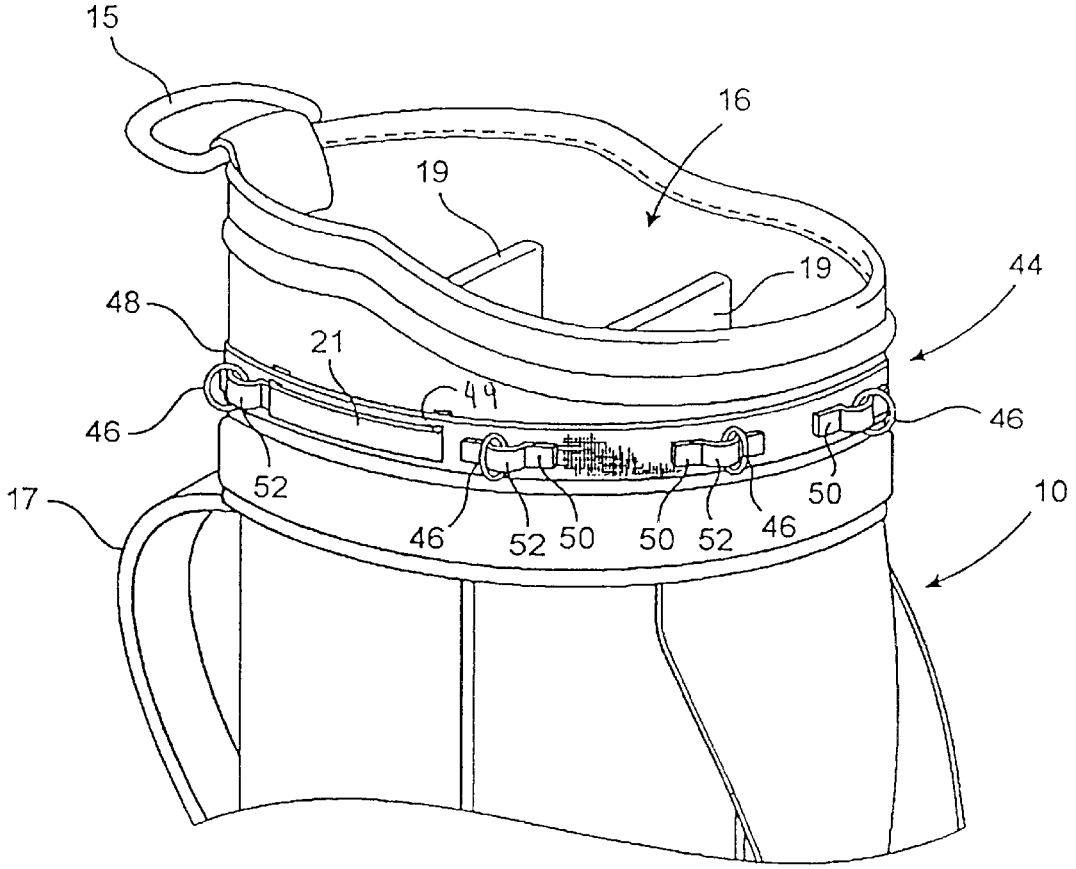
FIG. 6 is a perspective view in partial cutaway showing additional details of the holder assembly of the security assembly of the present invention.

As set for above the holder assembly 44 has the plurality of holders 46 secured along the length of the mounting member 48 in spaced relation to one another. This structure facilitates the selective removal or attachment of the plurality of holders and as such may include a coupling member 54, best shown in FIG. 5. The coupling member 54 is structured to adjustably secure the mounting member 48 so as to tightly fit about the golf bag 10, in the preferred position relative to the open end 16. As shown in FIG. 6, appropriately positioned apertures as at 49 may be formed in the mounting member 48 in order to accommodate the passage of support belt 21, for the partitions 19, through the side wall of the bag. Further, the elongated mounting member 48 may take a variety of different configurations including a band, strap, belt, cable, etc. Also the mounting member is formed from a high strength, cut resistant material such as metal, metallic mesh, or any other applicable material which is resistant to unauthorized removal from its intended position, as shown in FIGS. 1 and 5, by cutting, severing or other means. The present invention further contemplates that the plurality of holders 46 may be secured in their intended, spaced apart and surrounding position to the golf bag 10 by being permanently attached thereto. In such an embodiment, holders 46 may or may not include the connecting bracket 50 and may be attached directly to the golf bag, during the production of the golf bag by the original manufacturer.

Figure 4:
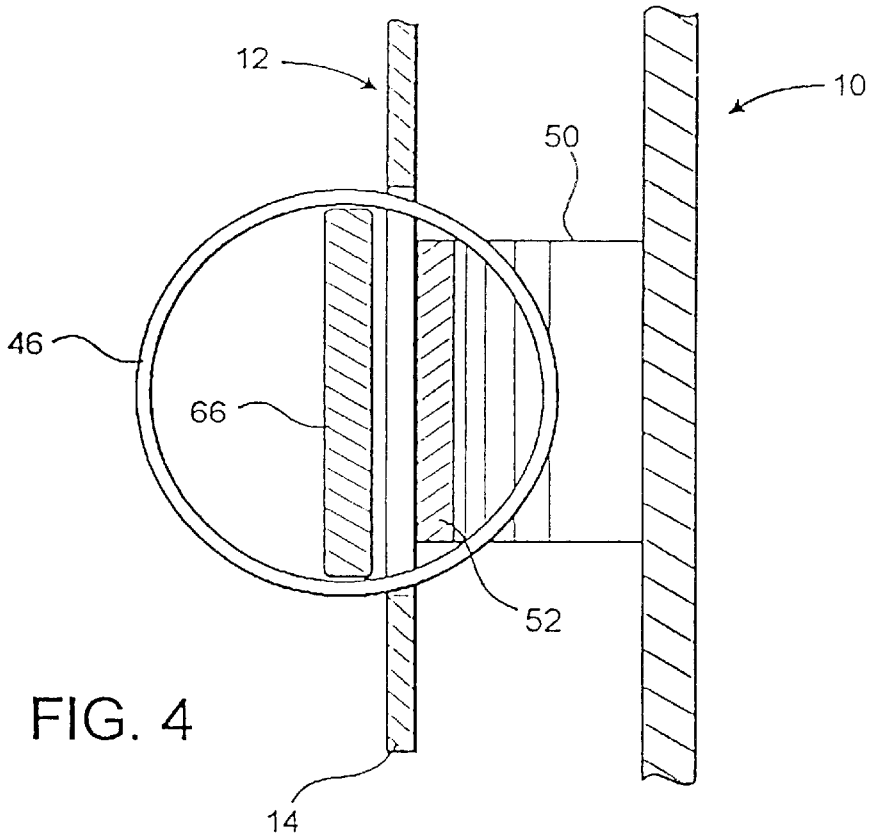
FIG. 4 is a sectional view of a portion of a holder assembly connected to a cooperatively disposed retaining member of the security assembly of the present invention.

Again with reference to the hood 10, a plurality of openings or apertures 60 are formed in spaced apart relation to one another and in substantially corresponding relation to the placement of the plurality of holders 46. The openings 60 are collectively formed along the periphery of the lower end 14 of hood 10. When the hood 10 is mounted in the operative position shown in FIGS. 2 and 3, the openings 60 are disposed in aligned, receiving relation to the holders 46 at a location spaced below but somewhat adjacent to the open end 16 of the golf bag 10. Further, the openings 60 are cooperatively dimensioned with holders 46 so as to allow the holders to at least partially pass therethrough as shown in FIGS. 2 through 4.

When the hood 12 and the golf bag 10 are operatively secured, a retainer assembly generally indicated as 64 is connected thereto so as to retain the hood 12 in a secure covering position over the open end 16 of the golf bag 10. The retainer assembly 64 includes an elongated retainer member 66 having a transverse dimension which preferably corresponds to the diameter or transverse dimension of the holders 46 but is sufficiently smaller to pass through each of the plurality of holders 46, as shown in FIG. 4. The retainer member 66 is thereby disposed in overlapping, retaining relation to the exterior surface of the hood 12 and in surrounding relation thereto so as to prevent the unauthorized removal of the hood. Also, the cooperative dimensioning and positioning of the holder assembly and the retainer assembly significantly restricts passage of a tool or a hand beneath the lower end of the hood 12 and into the interior of the golf bag, through the open end 16 thereof. The retainer member 66 may be in the form of a belt, band, strap, cable, etc., formed from a high strength, cut resistant material, which may be similar to the material from which the elongated mounting member 48 is formed. In addition, the retaining member 66 has its opposite ends, or other applicable structure, generally indicated as 68 in FIGS. 3, lockingly attached by a conventional or customized lock member 70, in a manner which serves to tightly and securely fit the retaining member 66 in its overlapping, retaining relation to the corresponding portion of the hood 12.

Figure 7:
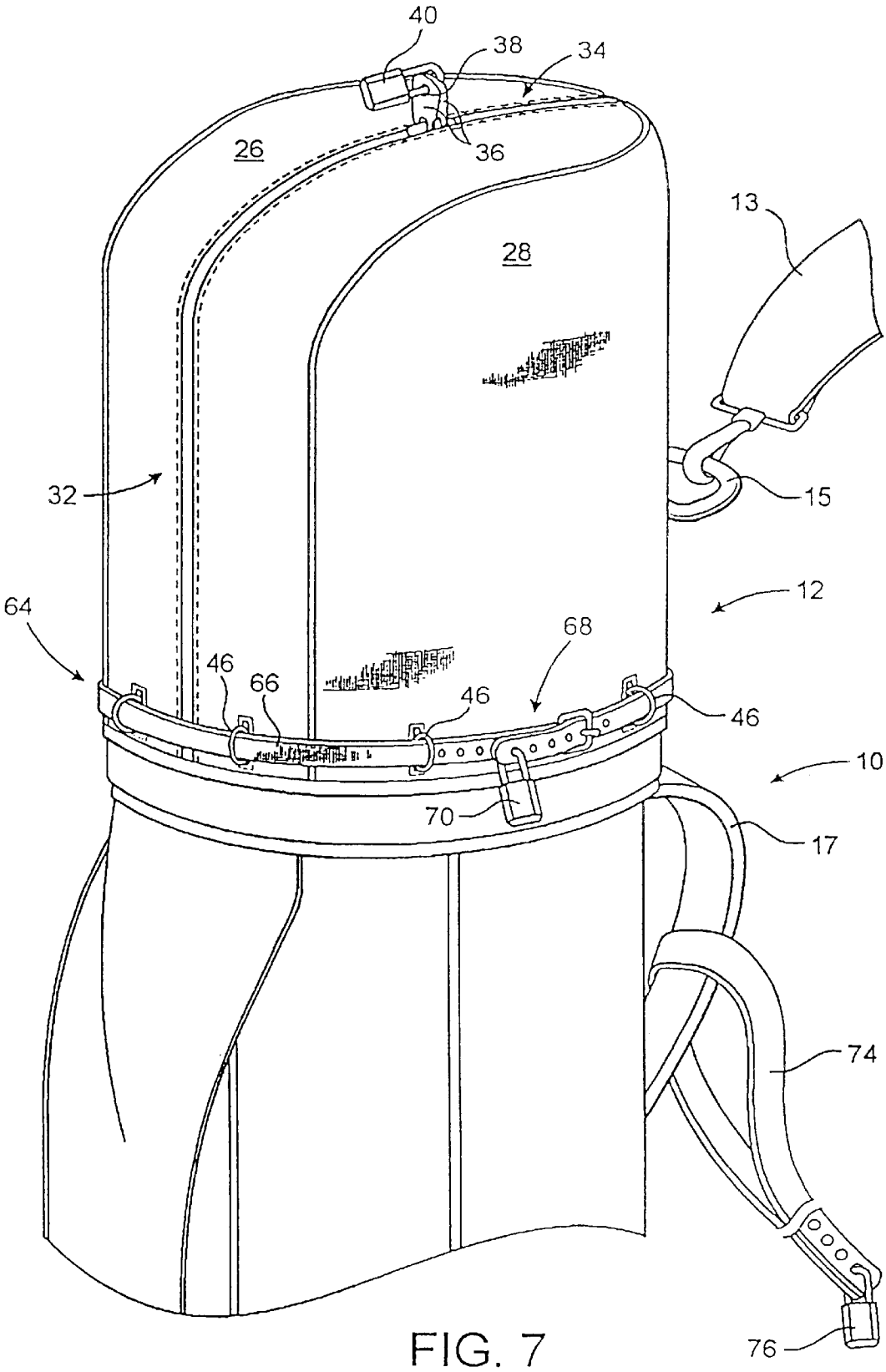
FIG. 7 is a perspective view in partial cutaway of the security assembly of the present invention in assembled form with a connecting member removably secured to a handle of a golf bag.

Other structural features of the security assembly of the present invention are shown in FIGS. 3 and 7 and include the provision of an elongated connecting member 74 having a sufficient length to be attached to various portions of the golf bag 10, such as through and in connection with the handle portion 17, formed as part of most conventional golf bags 12 and shown in FIG. 7. Alternately, as shown in FIG. 3 the elongated connecting member 74' may be looped about the elongated retaining member 66 and extend outwardly therefrom in engaging, somewhat surrounding relation to any of a variety of objects 75, such as a support rack on a golf cart. The connecting member 74' may also be attached to other supporting objects disposed at a location where the golf bag 10 is temporarily stored or positioned. In such a location, the connecting member 74' shown in FIG. 3 has the same structural features as the embodiment of the connecting member 74, in that both are formed of a high strength, cut resistant material, which may be similar to the material from which the mounting member 48 and/or the retainer member 66 are formed. Also a conventional or customized lock 76 may be used to interconnect the ends of the connecting member 74 or 74' so as to assure its secure attachment to the supporting object 75.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A security assembly for a golf bag, said assembly comprising:

a plurality of holders connected to the golf bag in spaced relation to one another, said plurality of holders collectively disposed substantially adjacent and in at least partially surrounding relation to an open end of the golf bag, a hood disposed in overlying covering relation to the open end of said golf bag, said hood removably interconnected and interlinked to said plurality of holders, and a retainer assembly interconnecting said golf bag and at least a majority of said plurality of holders and said hood, said retainer assembly forming a retaining relationship to said hood through attachment with said at least a majority of said plurality of holders;

said plurality of holders extend outwardly from an exterior of said hood in spaced apart locations thereon, said retainer assembly at least partially disposed in overlying retaining relation to said hood;

said hood including a plurality of spaced apart openings dimensioned to allow extension of said plurality of holders at least partially through said hood; and said retainer assembly is removably attached to said plurality of holders and selectively disposed into and out of retaining relation to said hood;

wherein said plurality of holders are removably mounted on said golf bag.

2. An assembly as recited in claim 1 wherein said retainer assembly includes at least a first lock mounted exteriorly of said hood and disposed to restrict unauthorized removal of said retainer assembly from its retaining relation to said hood.

3. An assembly as recited in claim 1 wherein said retainer assembly comprises at least one retainer member having an elongated configuration and disposed in a securing position relative to said hood.

4. An assembly as recited in claim 3 wherein said retainer member has a sufficient length to be concurrently attached to successive ones of said plurality of holders in at least partially surrounding relation to the golf bag and in retaining relation to a portion of said hood extending substantially along the length of said retainer member.

5. An assembly as recited in claim 4 wherein at least some of said plurality of holders include an at least partially closed configuration disposed to receive said retainer member therein.

6. An assembly as recited in claim 5 wherein substantially all of said plurality of holders include an at least partially closed configuration, said retainer member dimensioned to extend through said holders in surrounding relation to the golf bag and substantially overlying retaining relation to said hood.

7. An assembly as recited in claim 6 wherein (said retainer member) is formed of a high strength cut resistant material.

8. An assembly as recited in claim 1 wherein said retainer assembly comprises a retainer member having an elongated configuration of sufficient length to be attached to successive ones of said plurality of holders in at least partially surrounding relation to the golf bag and in retaining relation to a portion of said hood extending substantially along the length of said retainer member.

9. An assembly as recited in claim 8 wherein each of said plurality of holders include an at least partially closed configuration disposed to receive said retainer member therein, said retainer member dimensioned to extend through said holders in surrounding relation to the golf bag and in substantially overlying, retaining relation to said hood.

10. An assembly as recited in claim 9 wherein each of at lest a majority of said plurality of holders comprises a ring dimensioned to at least partially pass through a corresponding one of said openings in outwardly extending relation to an exterior of said hood.

11. An assembly as recited in claim 10 wherein said retainer assembly comprises an elongated retainer member sufficiently dimensioned to pass through substantially all of said rings in overlying retaining and substantially surrounding relation to said hood.

12. An assembly as recited in claim 11 wherein said retainer member is formed of a high strength, cut resistant material.

13. An assembly as recited in claim 1 wherein said hood comprises an access assembly movably mounted thereon and selectively disposable between a closed position and an open position respectively defined by adjacent hood segments of said hood disposed in a joined orientation or an at least partially separated orientation.

14. An assembly as recited in claim 13 wherein said hood comprises an access opening extending along corresponding peripheral portions of said hood segments and disposed to selectively provide and restrict access to an interior of the golf bag when said access assembly is respectively disposed in said open position and said closed position.

15. An assembly as recited in claim 14 wherein said access assembly comprises two closure structures each extending along a different portion of said opening in interconnecting relation to different, corresponding peripheral portions of said hood segments; each of said two closure structures selectively disposable to continuously connect or continuously separate said hood segments along the respective lengths of said closure structures; each of said closure structures including an operative member selectively disposable along the length thereof from a lower to an upper end of said hood to define said closed position and from said upper end to said lower end of said hood to define said open position.

16. An assembly as recited in claim 1 further comprising an elongated connecting member interconnected to said golf bag and having a sufficient longitudinal dimension to extend outwardly therefrom into secured engagement with a support structure, a second lock structure removably connected to said attachment member and cooperatively structured therewith to prevent an authorized detachment of said connecting member from the golf bag or the support structure.

17. An assembly as recited in claim 16 wherein said connecting member is formed from a high strength, cut resistant material and is disposed in engaging relation with said retainer assembly to define interconnection with the golf bag.

18. A security assembly for a golf bag, said assembly comprising;

a) a holder assembly including a plurality of holders interconnected to one another and collectively mounted in substantially adjacent and at least partially surrounding relation to an open end of the golf bag, b) a hood disposed in overlying, covering relation to the open end and removably interconnected to said plurality of holders, c) a retainer assembly mounted on the golf bag in interconnecting relation to said plurality of holders and in retaining relation to said hood, and d) said holder assembly further including an elongated mounting member removably attached to the golf bag, said plurality of holders secured to said mounting member and thereby removably interconnected to the golf bag with said mounting member.

19. An assembly as recited in claim 18 wherein said retainer assembly comprises an elongated retainer member sufficiently dimensioned to removably engage said plurality of holders in overlying retaining and substantially surrounding relation to said hood.

20. An assembly as recited in claim 19 wherein both said retainer member and said mounting member are formed of a high strength, cut resistant material.

21. An assembly as recited in claim 18 wherein said hood includes a plurality of spaced apart openings about its depending open end dimensioned to allow extension of said plurality of holders at least partially therethrough.

22. An assembly as recited in claim 21 wherein at least some of said plurality of holders include an at least partially closed configuration disposed to receive said retaining member therein.

23. A security assembly for a golfbag, said assembly comprising;

a holder assembly including a plurality of holders interconnected to one another and collectively mounted in substantially adjacent and at least partially surrounding relation to an open end of the golf bag, a hood disposed in overlying, covering relation to the open end and removably interconnected to said plurality of holders, said hood comprising a plurality of spaced apart openings dimensioned to allow extension of said plurality of holders at least partially therethrough, a retainer assembly including at least one retainer member having an elongated configuration and disposed in a securing position relative to said hood, said retainer member having a sufficient length to be concurrently attached to successive ones of said plurality of holders in at least partially surrounding relation to the golf bag and in retaining relation to a portion of said hood, and said plurality of holders including an at least partially closed configuration disposed to receive said retainer member therein; and, said holder assembly further includes an elongated mounting member removably attached to the golf bag and said plurality of holders secured to said mounting member and thereby removably interconnected to the golf bag with the mounting member.

24. An assembly as recited in claim 23 wherein said hood comprises an access assembly movably mounted thereon and selectively disposable between a closed position and an open position respectively defined by adjacent hood segments of said hood disposed in at least a joined orientation or in at least partially separated orientation.

25. An assembly as recited in claim 24 wherein said access assembly further comprises two closure structures each extending along a portion of said opening in interconnecting relation to different, corresponding peripheral portions of said hood segments, each of said two closures structured to continuously join or separate said hood segment along the respective lengths thereof; each of said closures including an operative member selectively disposable along the length of said closure structure from a lower end to an upper end to define said closed positioned and from said upper end to said lower end to define said open position.

* * * * *